US005581328A

United States Patent [19]

Yashiro

[11] Patent Number: 5,581,328

[45] Date of Patent: Dec. 3, 1996

[54] PROCESS CARTRIDGE HAVING CONNECTABLE FIRST AND SECOND FRAMES AND A RECORDING APPARATUS USING SUCH A PROCESS CARTRIDGE

[75] Inventor: Masahiko Yashiro, Yokohama, Japan

[73] Assignee: Canon Kabushiki Kaisha, Tokyo, Japan

[21] Appl. No.: 418,803

[22] Filed: Apr. 7, 1995

Related U.S. Application Data

[62] Division of Ser. No. 949,866, Nov. 23, 1992, Pat. No. 5,450,166.

[30] Foreign Application Priority Data

Apr. 10, 1991 [JP] Japan ..... 3-77606

[51] Int. Cl.[6] ..... G03G 21/18

[52] U.S. Cl. ..... 355/210

[58] Field of Search ..... 355/200, 210, 355/211, 245, 260

[56] References Cited

U.S. PATENT DOCUMENTS

| | | | |
|---|---|---|---|
| 4,866,482 | 9/1989 | Hirasawa et al. | 355/260 |
| 5,028,966 | 7/1991 | Kozuka et al. | 355/210 X |
| 5,061,959 | 10/1991 | Kinoshita et al. | 355/210 |
| 5,115,272 | 5/1992 | Ohmori | 355/200 |
| 5,153,649 | 10/1992 | Park | 355/260 |

FOREIGN PATENT DOCUMENTS

| | | |
|---|---|---|
| 0329145 | 8/1989 | European Pat. Off. . |
| 0405514 | 1/1991 | European Pat. Off. . |
| 3907875 | 9/1989 | Germany . |
| 60-168175 | 8/1985 | Japan . |
| 61-279870 | 12/1986 | Japan . |
| 1244472 | 9/1989 | Japan . |
| 3-15864 | 1/1991 | Japan . |

*Primary Examiner*—Joan H. Pendegrass

*Attorney, Agent, or Firm*—Fitzpatrick, Cella, Harper & Scinto

[57] ABSTRACT

The present invention realizes to shorten the assembling process of a process cartridge, by employing a first support member supporting an image bearing member, a second support member supporting a development unit for acting on the image bearing member to thereby develope an image of the image bearing member, a defining member for defining the rotary shaft between the first and second support members, and a compression spring for generating an elastic force between the image bearing member and the development unit.

27 Claims, 8 Drawing Sheets

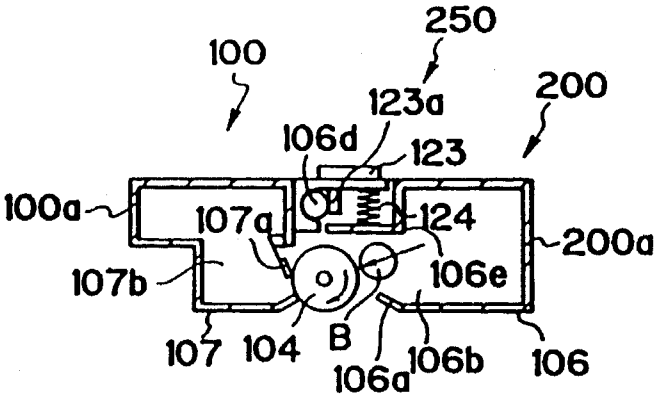
FIG. 2(b)
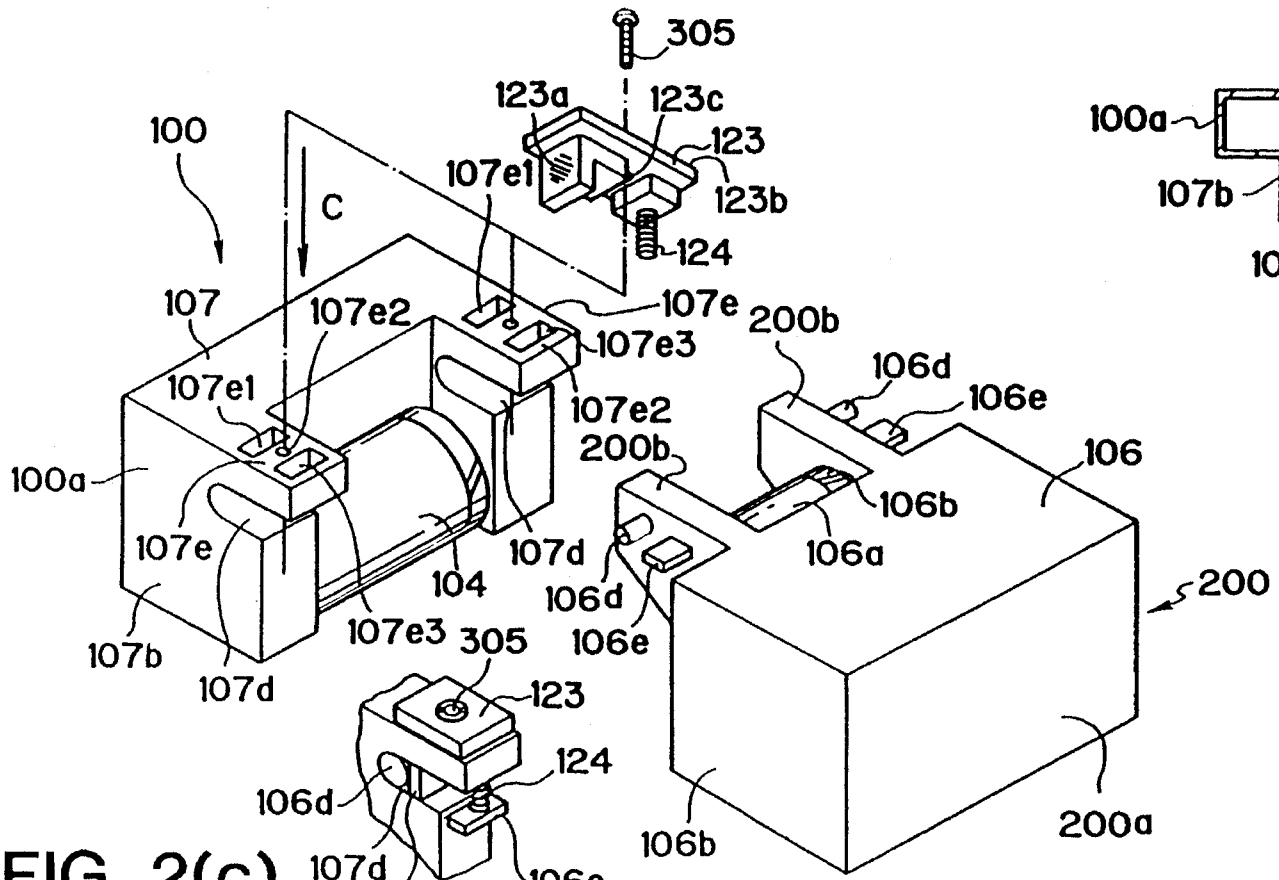
FIG. 2(a)
FIG. 2(c)

PROCESS CARTRIDGE HAVING CONNECTABLE FIRST AND SECOND FRAMES AND A RECORDING APPARATUS USING SUCH A PROCESS CARTRIDGE

This application is a division of application Ser. No. 07/949,866 filed Nov. 23, 1992, now U.S. Pat. No. 5,450,166.

FIELD OF THE INVENTION

The present invention relates to a process cartridge, a recording apparatus and a method for assembling a process cartridge.

The process cartridge means an integral unit including at least an image bearing member (for example an electrophotographic photosensitive member) and developing means, rendered attachable to and detachable from a recording apparatus.

The recording apparatus can be, for example, an electrophotographic copying apparatus, a laser beam printer (LBP), a facsimile apparatus, a word processor or the like.

DESCRIPTION OF THE RELATED ART

In the following there will be explained the background art of the present invention.

FIGS. 1(*a*) and 1(*b*) are views showing the background art of the present invention, wherein FIG. 1(*a*) is a schematic lateral cross-sectional view of a process cartridge not mounted on the recording apparatus, and FIG. 1(*b*) is a perspective view in which the process cartridge is divided into a developing unit and a cleaner unit.

As shown in FIGS. 1(*a*) and 1(*b*), a photosensitive drum unit 7 is provided with a photosensitive drum 4, and a cleaning blade 7*a* and a used toner reservoir 7*b* constituting a cleaner 7*e* for cleaning the periphery of said photosensitive drum 4.

Also a developing unit 6 is provided with a developing sleeve 6*a* and a toner reservoir 6*b* constituting a developer 6*i*. (In these drawings, the toner in the toner reservoir 6*b* and in the used toner reservoir 7*b* is omitted.)

Pins 6*d* formed on arms 6*c* of the unit 6 are fitted in holes 7*c* of the unit 7, and are then prevented from displacement in the thrust direction by a thrust stopper 6*f* such as a ring, fitted on a groove 6*e* of the pin 6*d*. Thus the units 6, 7 are mutually rotatable about said pins 6*d*. Subsequently tension springs 9 are applied between pins 6*g* provided on both sides of the unit 6 and pins 7*d* provided on both sides of the unit 7, thereby generating a tensile force between the units 6 and 7. Thus the units 6, 7 are integrated in a state in which the photosensitive drum 4 and the developing sleeve 6*a* are mutually contacted with a predetermined pressure in a direction A.

When the process cartridge 1 is mounted on a laser beam printer (not shown), the photosensitive drum 4 is driven by a driving gear (not shown) of the main body of the apparatus, while the developing sleeve 6*a* is rotated by a developing roller gear 6*h* meshing with a photosensitive drum gear 4*a*. In general, the pins 6*d* and the holes 7*c* are positioned in the angular direction of meshing pressure of said gears, in order not to receive the force in the rotational direction.

However, the above-explained process cartridge requires a cumbersome operation in the assembling, as the tension springs 9 cannot be placed between the pins 6*g* and 7*d* unless they are once extended with a force exceeding the necessary tensile force. Also in case of disassembling the process cartridge into the cleaner 7 and the developer unit 6 for maintenance or the like, there have to be detached the springs 9 and then the thrust stopper 6*f*. In this manner cumbersome operations are involved in the assembling and disassembling of such conventional process cartridge.

On the other hand, the present applicant made an invention enabling the process cartridge to be made compact by the use of compression coil springs in contacting the developing sleeve with the photosensitive drum with a predetermined pressure, and applied for a patent in Japan on this invention (Japanese Patent Application No. 63-69735, filed Mar. 25, 1988; Japanese Patent Laid-open Application No. 1-244472, laid open Sep. 28, 1989).

The present invention is an extension of the above-mentioned background art and of the above-explained invention of the present applicant.

SUMMARY OF THE INVENTION

An object of the present invention is to provide a process cartridge enabling further compactization, an image forming apparatus adapted therefor, and a method for assembling such process cartridge.

Another object of the present invention is to provide a process cartridge capable of reducing the assembling process, an image forming apparatus adapted therefor, and a method for assembling such process cartridge.

Still another object of the present invention is to provide a process cartridge capable of reducing the disassembling process, an image forming apparatus adapted therefor, and a method for assembling such process cartridge.

Still another object of the present invention is to provide a process cartridge with improved assembling and disassembling property, an image forming apparatus adapted therefor, and a method of assembling such process cartridge.

In a principal aspect of the present invention, there is provided a process cartridge detachably mountable to a main assembly of a recording apparatus, said cartridge comprising a first frame supporting an image bearing member; and a second frame supporting development means for acting on said image bearing member to thereby develop a latent image of said image bearing member, wherein said first frame and said second frame are configured such that a portion of said first frame overlaps a portion of said second frame, when said first frame and said second frame are coupled together, in such a manner that said first and second frames mutually cooperate to form an exposure aperture for irradiating said image bearing member with image information when said process cartridge is mounted in the main assembly of the recording apparatus.

In another principal aspect of the present invention, there is provided a recording apparatus for recording on a recording medium, comprising mounting means for removably mounting a process cartridge including: a first frame supporting an image bearing member; and a second frame supporting development means for acting on said image bearing member to develop a latent image on said image bearing member, wherein said first and second frames are configured so that said first frame has a portion that rockably overlaps a portion of said second frame when said first and second frames are coupled together; and transport means for transporting the recording medium.

In still another principal aspect of the present invention, there is provided a process cartridge including at least an image bearing member and development means and detachably attachable to an image forming apparatus, wherein a member for defining the position of said development means relative to the image bearing member and a compression spring for biasing said development means toward the image bearing member are constructed as an integral unit, and said unit is utilized in positioning the development means in a support member for the image bearing member.

Owing to the above-mentioned characteristic configurations, the present invention achieves simplification of the assembling process of the process cartridge, since, because of said characteristic configurations, the present invention allows assembly of the process cartridge without the use of a tension spring. Also because of said characteristic configurations, the present invention allows mounting of the compression spring in an easy manner during the assembly of the process cartridge.

Also owing to said characteristic configurations, the present invention allows formation of an aperture (for example an aperture for exposure) without sacrificing the strength of the casing of the process cartridge. Because of said characteristic configurations, the present invention allows formation of the aperture, without forming a hole in the casing.

BRIEF DESCRIPTION OF THE DRAWINGS

FIGS. 2(*a*), 2(*b*) and 2(*c*) are respectively a perspective view, a lateral cross-sectional view and a perspective view showing a combined state, of a preferred embodiment of the process cartridge of the present invention;

DESCRIPTION OF THE PREFERRED EMBODIMENTS

Figure 1B:
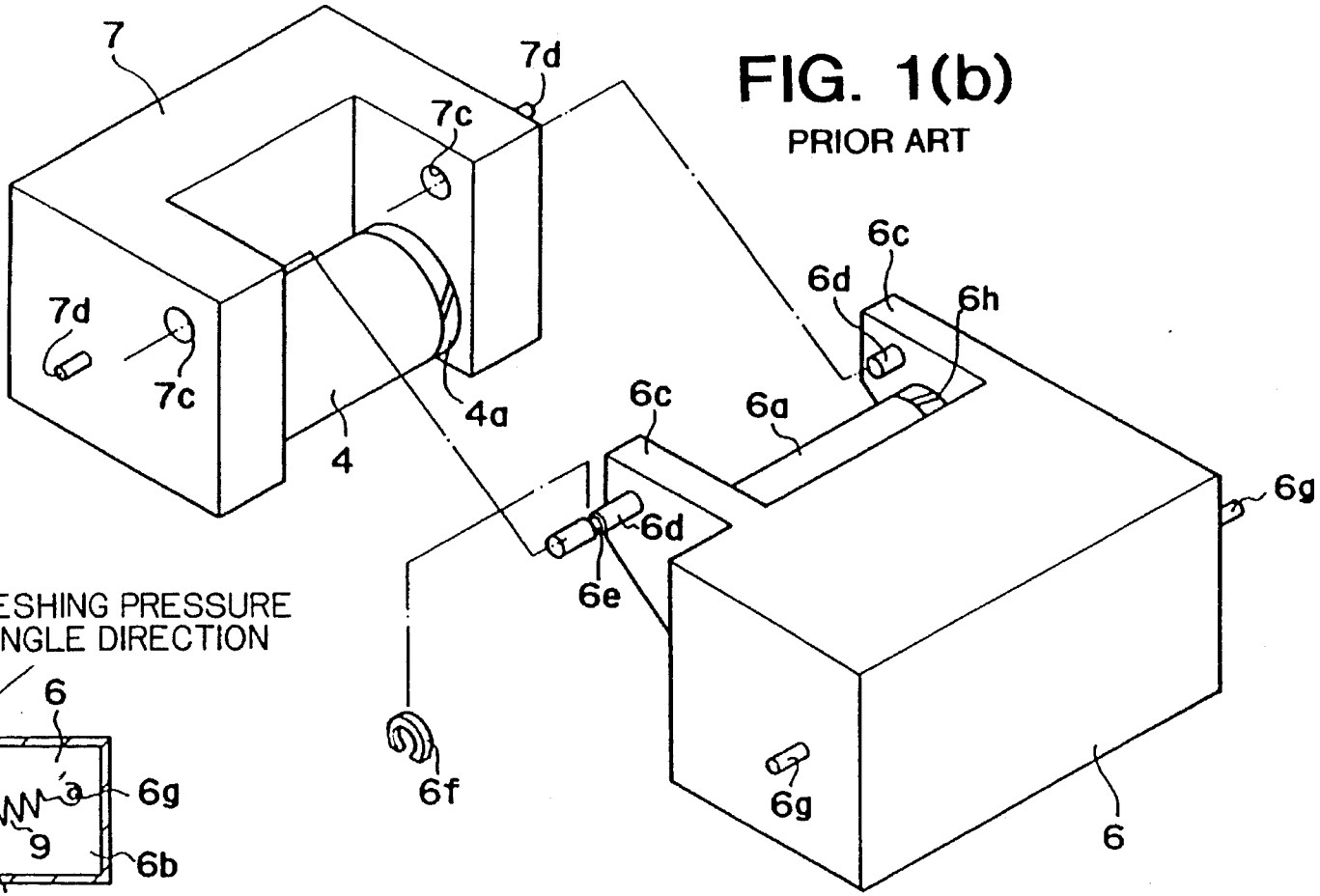
FIG. 1(b) PRIOR ART
FIGS. 1(*a*) and 1(*b*) are respectively a lateral cross-sectional view and a perspective view, showing the background art of the present invention.
Figure 1A:
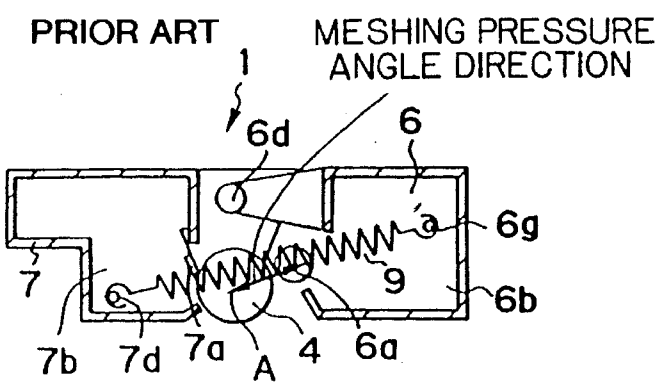
FIG. 1(a) PRIOR ART

Now the present invention will be clarified in detail by preferred embodiments thereof shown in the accompanying drawings.

FIGS. 2(*a*) and 2(*b*) are respectively a schematic perspective view and a schematic cross-sectional view of a preferred embodiment of the process cartridge of the present invention. FIG. 2(*a*) illustrates a state in which a photosensitive drum unit 100 and a developing unit 200 are mutually disassembled.

In the present embodiment, a process cartridge 300 is constructed by coupling the photosensitive drum unit 100 and the developing unit 200. The photosensitive drum unit 100 rotatably supports an electrophotographic photosensitive drum 104 in a frame 100*a*, by means of bearings. It also is provided with a cleaning blade 107*a* and a used toner reservoir 107*b*, constituting a cleaner 107 for cleaning the periphery of the photosensitive drum 104. On the other hand, the developing unit 200 supports, in a frame 200*a*, a developing sleeve 106*a* and a toner reservoir 106*b*, constituting a developing device 106, wherein the developing sleeve 106*a* serves to transport the toner in the toner reservoir 106*b* to a developed area of the photosensitive drum 104.

In the following there will be explained a procedure for coupling the photosensitive drum unit 100 and the developing unit 200.

In the present embodiment, cylindrical projections 106*d*, formed on arms 200*b* of the developing unit 200 are fitted in U-shaped grooves 107*d* provided in the drum unit 100, and, after the fitting of the units 100, 200 in this manner, a stopper unit 123 in which a pressurizing spring (compression spring in this case) 124 is integrated (for example by snap fitting of an end of the compression spring) is fitted in a fixing part 107*e*, positioned above each of the U-shaped grooves 107*d*. Then the stopper unit 123 is fixed to the unit 100 by a screw 305 inserted in a direction c. In this operation, a face 123*a* of the stopper unit 123 and the U-shaped groove 107*d* define the position of the projection 106*d* of the developing unit 200, thereby limiting the position thereof. Also the pressure springs 124 press spring seats 106*e* of the developing unit 200, thereby applying a biasing force in a direction B of mutual impingement of the photosensitive drum 104 and the developing sleeve 106*a*.

The stopper unit 123 is integrally provided with a base plate 123*b*, a fixing screw hole 123*c* provided therein, a perpendicular plate 123*a* formed on said base plate 123*b*, and a compression spring 124.

On the other hand, the fixing part 107*e* formed in the drum unit 100 is provided with a hole 107*e*1 into which said perpendicular plate 123*a* is to be fitted, a female thread part 107*e*2 for fixing the screw 305, and a hole 107*e*3 for passing the spring 124.

Thus, after the projections (pins) 106*d* of the unit 200 are fitted in the deepest parts of the grooves 107*d* of the unit 100, the stopper units 123 are fixed on the fixed parts 107*e*. More specifically, the perpendicular plate 123*a* of the stopper unit 123 is fitted in the hole 107*e*1, while the spring 124 is made to pass through the hole 107*e* and to be received in a compressed state by the spring seat 106*e* of the unit 200, and the screw 305 is fixed, through the screw hole 123*c*, into the female thread part 107*e*2.

In this manner the units 100 and 200 are coupled so as to be mutually rotatable about the pins 106*d*, thereby completing the process cartridge 250. The positional relationship between the periphery of the photosensitive drum 104 and that of the developing sleeve 106*a* is defined in thus coupled state of the units 100, 200, and the developing sleeve 106*a* is pressed toward the photosensitive drum 104 by the elastic force of the compression springs 124. (In the present embodiment, the elastic force of the compression springs is selected at about 2 kg, whereby a pressing force of about 1 kg is applied to the developing sleeve.)

A drum gear 104*a*, provided at a side of the photosensitive drum 104, meshes with a developing sleeve gear 106*b*, provided at a side of the developing sleeve 106*a*, thereby transmitting the rotating force, received from the main body of the printer, to the developing sleeve.

In the above-explained configuration, the developing unit 106 can be attached or detached in the direction of the U-shaped grooves 107*d*. Consequently the projections (pins) 106*d* can both be constructed outwards (or inwards), so that the thrust stopper can be dispensed with.

Also as the stopper unit 123 is inserted in the direction C and fixed in said direction, the pressurizing of the developing device can be realized simultaneously with the mounting of the stopper unit 123, and there is no longer required the conventional cumbersome operation of mounting the tension springs.

Also at the disassembling, the pressure is gradually released by loosening the stopper units, and the disassembling operation is extremely easy because of the absence of the thrust stopper.

Thus, the above-explained embodiment realizes the positioning of the developing device relative to the image bearing member, by means of a unit provided with compression springs, thereby improving the assembling and disassembling property of the process cartridge.

In the present embodiment, the photosensitive drum unit supports the cleaner, but such configuration is not essential. The process cartridge of the present invention needs only to be attachable to and detachable from the main apparatus in a state in which at least the photosensitive drum and the developing unit are integrally supported.

In the following, there will be explained another preferred embodiment of the present invention, with reference to FIGS. 3 to 7.

Figure 3:
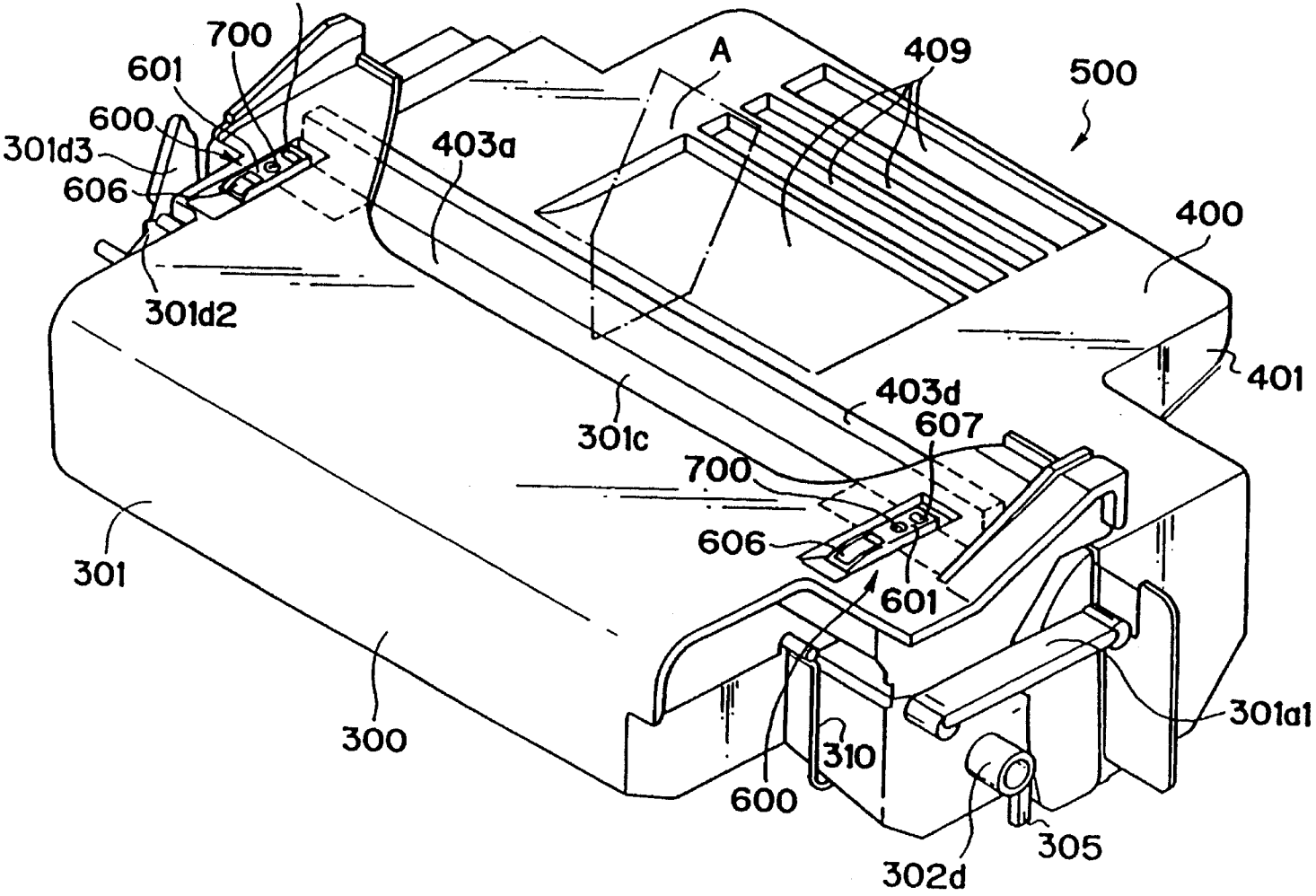
FIG. 3 is an external perspective view of a preferred embodiment of the process cartridge of the present invention.
Figure 4:
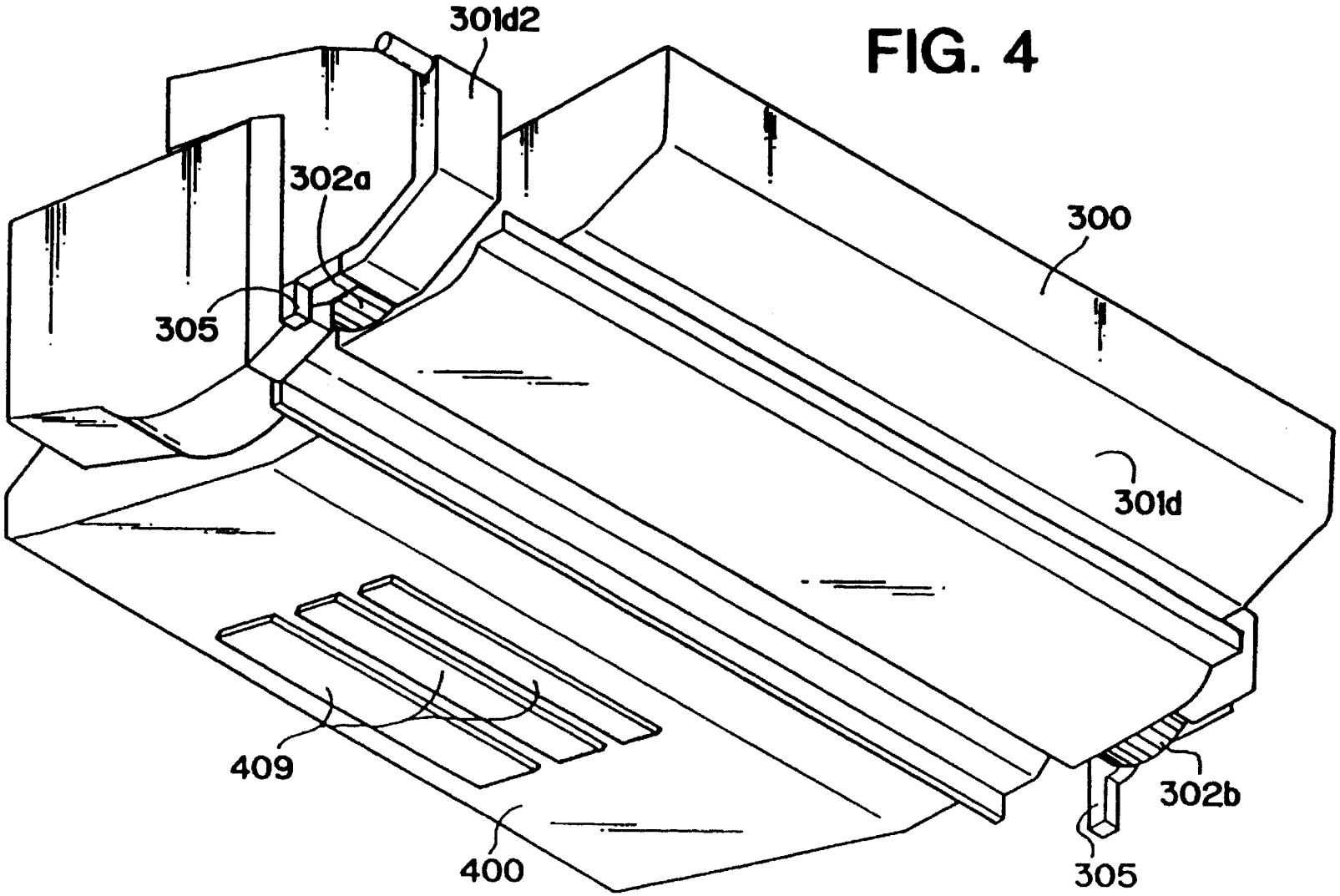
FIG. 4 is an external perspective view, seen from below, of the process cartridge shown in FIG. 3.
Figure 5:
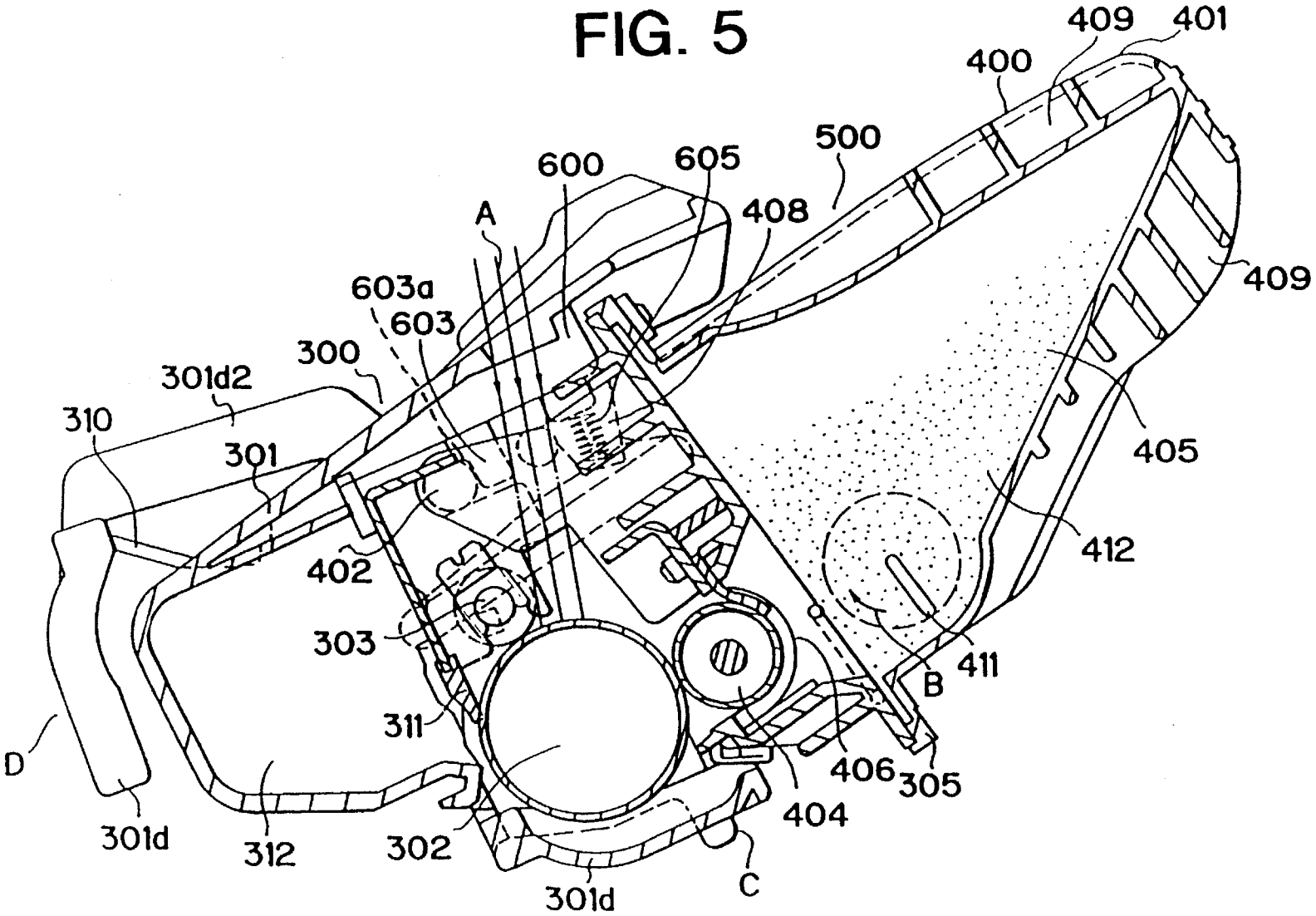
FIG. 5 is a lateral cross-sectional view of the process cartridge shown in FIG. 3.
Figure 6A:
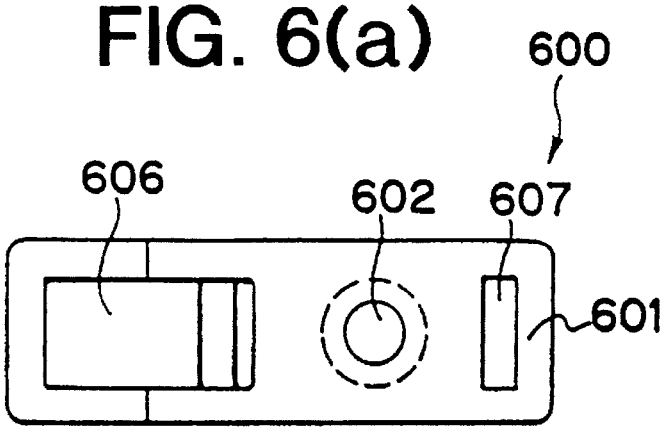
FIGS. 6(*a*) and 6(*b*)are respectively a plan view and a lateral view of an embodiment of coupling means adapted in the present invention.
Figure 6B:
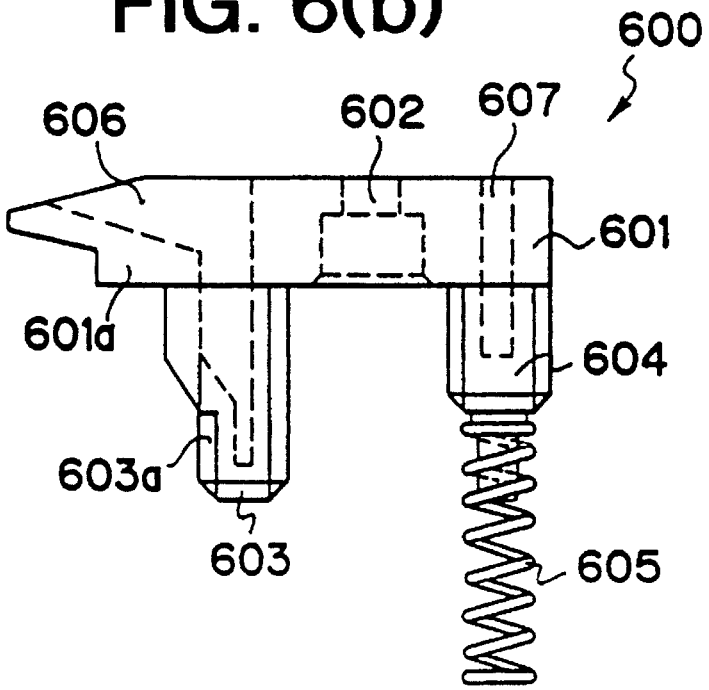
Figure 7A:
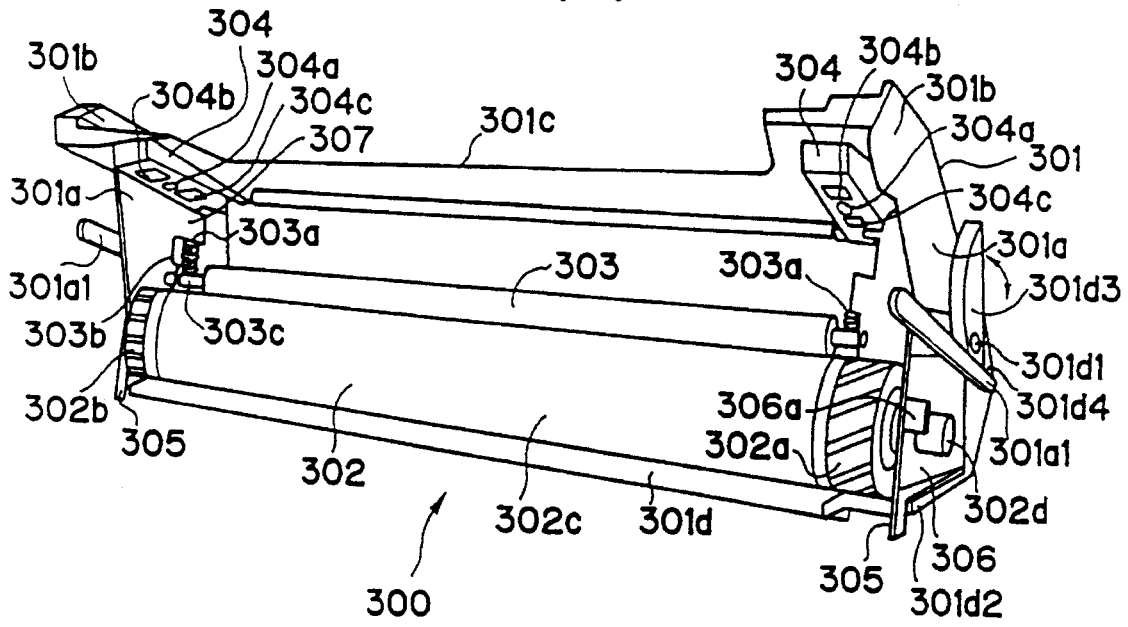
FIGS. 7(*a*) and 7(*b*) are perspective views respectively of a photosensitive drum unit and a developing unit, constituting the process cartridge shown in FIG. 3.
Figure 7B:
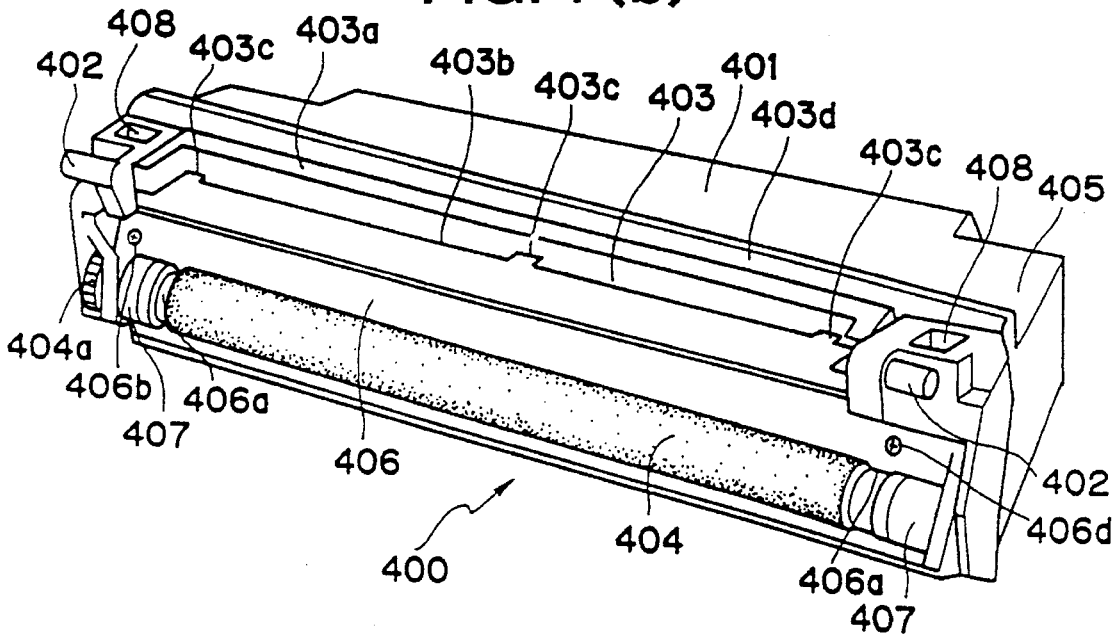

FIG. 3 is an external perspective view, seen from above, of a preferred embodiment of the process cartridge of the present invention, FIG. 4 is an external perspective view thereof seen from below, FIG. 5 is a lateral cross-sectional view of the process cartridge shown in FIG. 3, FIGS. 6(*a*) and 6(*b*) are respectively a plan view and a lateral view of an embodiment of the coupling means, and FIGS. 7(*a*) and 7(*b*) are perspective views respectively of a photosensitive drum unit and a developing unit, constituting the process cartridge shown in FIG. 3.

At first, the photosensitive drum unit 300 will be explained with reference to FIG. 7 (*a*).

A unit frame 301 is provided with attach/detaching guides 301*a*1 provided on the external faces of lateral plates 301*a*, upper arms 301*b* extending diagonally upwards, and an exposure aperture 301*c* positioned between said arms 301*b*. Said lateral plates 301*a*, guides 301*a*1, arms 301*b* and exposure aperture are integrally molded. Under said frame 301 there is openably provided a photosensitive drum protecting cover 301*d*. Said guides 301*a*1 serve to guide the process cartridge 500 in attaching to or detaching from the printer (to be explained later). Said exposure aperture 301*b* constitutes an exposure aperture in cooperation with a frame of a developing unit 400, when the process cartridge 500 is composed by coupling the photosensitive drum unit 300 and the developing unit 400. The protective cover 301*d* is mounted on an arm 301*d*2 rotatable about a shaft 301*d*1. It is retracted from a protecting position (illustrated) for protecting the periphery of the photosensitive drum to a retracted position, when an engaging part 301*d*3 integral with the arm 301*d*2 engages with an engaging part of the main body, and returns to said protecting position when said engaging parts are disengaged upon detachment of the cartridge 500 from the main body. In this manner the protective cover 301*d* is opened and closed, in response to the attachment and detachment of the cartridge.

Between the lateral plates 301*a*, a photosensitive drum 302 is rotatably supported by bearings. Said drum 302 is provided with a helical gear 302*a* at an end, a flat-tooth gear 302*b* at the other end, and an electrophotographic photosensitive member 302*c* (for example an amorphous photosensitive member of an organic photoconductor (OPC)) on the periphery. Upon attachment of the cartridge in the main body, said helical gear 302*a* meshes with a helical gear (not shown) of the main body, thereby receiving the drum driving force. Also when the units are coupled, said gear meshes with a developing sleeve gear of the developing unit 400, thereby transmitting the sleeve driving force. A conductive bearing 302*d* engages with a conductive part (not shown) of the main body, thereby grounding the drum 104.

A charging roller 303 is pressed, with a predetermined pressure, to the periphery of the drum 302, by means of springs 303*a*. An electrical contact spring 303*b* elastically contacts the shaft 303*c* of the charging roller 303, thereby applying a predetermined voltage from the main body to said charging roller 303.

In the present embodiment, in each of the arms 301*b* there is provided an elongated recess 304, including therein apertures 304*b*, 304*c* on both sides of a female thread part 304*a*. The front aperture 304*b* serves to pass a compression spring provided in a stopper unit to be explained later, while the rear aperture 304*c* serves to accept a perpendicular plate also provided in the stopper unit.

Below said recess 304, there is provided a rectangular groove 307, for accepting a pin of the developing unit 400 to be explained later.

Legs 305 serve to support the process cartridge 500 when it is detached from the main body. A conductive metal plate 305 is mounted on the lateral plate 301*a*, in contact with the bearing 302*d*, by means of a screw 306*a*.

In the following, explained is the developing unit 400, with reference to FIG. 7 (*b*).

A unit frame 401 is provided, at upper lateral positions, with externally extending cylindrical pins 402, between which formed is an exposure aperture 403. There are also provided a light shield plate 403*a* for limiting the light other than from the exposure aperture 403, a rear light shield plate 403*b* for further limiting the light entering from the exposure aperture, with notches 403*c* at the center and at both ends in order not to hinder the image exposure, and a vertical light shield plate 403*e*. Said rear light shield plate 403*b* protrudes toward the photosensitive drum 302, beyond the light shield plate 403*a*.

Concave portions, e.g., rectangular grooves 408, are provided for receiving compression springs, to be positioned in the vicinity of circular pillar-like portions, e.g., the pins 402, as will be explained later.

A developing roller 404, constituting the developing means, transports by rotation the toner from a toner reservoir 405 to a developed portion of the photosensitive drum 302. A magnet roller is incorporated in said developing sleeve 404. A helical gear 404*a* receives the driving force by meshing with the drum gear 302*a* of the photosensitive drum unit 300 when the units 300, 400 are coupled to constitute the cartridge 500.

A doctor blade 406 is provided for limiting the thickness of toner on the periphery of the sleeve 404. On both ends, there are provided felt members 406*a* for preventing lateral leak of the toner. Outside areas 406*b* are free from toner deposition.

Plastic rollers 407 are provided on both ends of the sleeve 404, and have a diameter slightly larger than that of the sleeve 404. Consequently in the present embodiment, when the units 300, 400 are coupled to constitute the process cartridge 500, the periphery of the photosensitive drum 302 comes into contact with those of the rollers 407, thereby defining a small gap (for example 200–500μ in the present embodiment) between the surfaces of the drum 302 and the sleeve 404. However such configuration is not essential, and said surfaces may be in direct contact. Screw 406*b* fix the blade 406 onto the frame 401.

In the following, there will be explained a stopper unit 600, serving as coupling means for coupling the units 300 and 400, with reference to FIGS. 6(*a*) and 6(*b*), which are respectively a plan view and a lateral view.

A screw hole 602, penetrating through a base member 601, accepts the male screw 700 (FIG. 3). A perpendicular plate 603 extends downwards from the lower face 601*a* of the base member 601, and serves to define the position of the pin 402 of the developing unit 400 by a lower lateral end 603*a*. A spring seat 604 is provided parallel to the perpendicular plate 603, and supports, at the end thereof, a compression spring 605 extending further downwards beyond the perpendicular plate 603. There are also provided hollow parts 606, 607.

The process cartridge 500 is assembled by coupling the units 300 and 400 in the following manner.

At first the photosensitive drum 302 of the unit 300 and the developing sleeve 404 of the unit 400 are positioned in mutually opposed manner, and the pins 402 on both sides of the unit 400 are inserted deeply into the rectangular grooves 307 on both sides of the unit 300, whereby the units 300 and 400 are mutually combined in such a manner that the arms 301*b* of the unit 300 cover the frame 401 of the unit 400.

Then, the stopper unit 600 is fitted into each of the recess 304. In this state, the front aperture 304*c* of the unit 300 faces the rectangular groove 408 of the unit 400, while the rear aperture 304*c* faces the rectangular groove 307. Thus the stopper unit 600 is fitted into the recess 304, by fitting the compression spring 605 through the front aperture 304*b* into the rectangular groove 408, and fitting the perpendicular plate 603 through the rear aperture 304*c*.

Subsequently, the male screw 700 is fixed to the female thread 304*a* through the screw hole 602 of the stopper unit 600, thereby fixing the stopper unit 600 to the unit 300. The assembly of the process cartridge 500 is thus completed (FIGS. 3 to 5).

Thus the pins 402 of the unit 400 are limited from movement by the lower lateral ends 603*a* of the perpendicular plates 603, whereby the units 300 and 400 are integrally coupled, with the pins 402 as the center of rotation. At the same time with the mounting of the stopper unit 600, the developing sleeve 404 is pressed by the elastic force of the compression springs 605, toward the periphery of the photosensitive drum 302. In the present embodiment, the peripheries of the drum 302 and the rollers 407 come into mutual contact, thereby defining the positions thereof. (In the present embodiment, a gap (for example about 200–500μ) is formed between the peripheries of the drum 302 and the sleeve 404 in order to enable so-called jumping development, but these members may be in direct contact.)

Thus, the present embodiment can achieve the coupling of the photosensitive drum unit 300 and the developing unit 400 and the positioning of the photosensitive drum 302 and the developing sleeve 404 in a same assembling step, thereby shortening the assembling process.

Also in the present embodiment, when the units 300 and 400 are mutually coupled, the exposure aperture 301*c* of the unit 300 becomes positioned above the exposure aperture 403 of the unit 400, thereby defining an exposure aperture of a predetermined size (for introducing the image light from the main body of the printer). Thus, in the coupled state of the units 300 and 400, the frames 301, 401 cooperate each other to form the exposure aperture. The present embodiment can therefore improve the strength of the frames, as a large hole for image exposure need not be formed in one of the frames. Also the present embodiment can minimize the intrusion of unnecessary light from the exposure aperture, because of the presence of the light shield plate 403*a*, rear light shield plate 403*b* and vertical light shield plate 403*c* in the process cartridge 500.

In FIG. 3, an arrow A indicates the image exposing light. Parallel recesses 409, formed on the external surface of the frame 401 of the unit 400 serve as grips in the transportation of the cartridge 500 (said recesses 409 being omitted from illustration in FIG. 7(*b*)). Arms 310 support the protective cover 301*d*, at a side opposite to the side supported by the arms 301*d*2. FIG. 5 illustrates a new process cartridge 500 prior to use. In FIG. 5, there is provided a rotary blade 411, rotated in a direction B to feed the toner 412 toward the sleeve 404. An elastic cleaning blade 311, serving as the cleaner, is in contact with the periphery of the photosensitive drum 302, thereby removing the toner remaining thereon after the image transfer. A used toner reservoir 312 stores the toner scraped by the blade 311. C indicates the protecting position of the protective cover 301*d*, while D indicates the retracted position thereof. In this drawing, for facilitating the understanding, the protective cover 301*d* is illustrated in solid lines both in the protecting position C and in the retracted position D.

Figure 8:
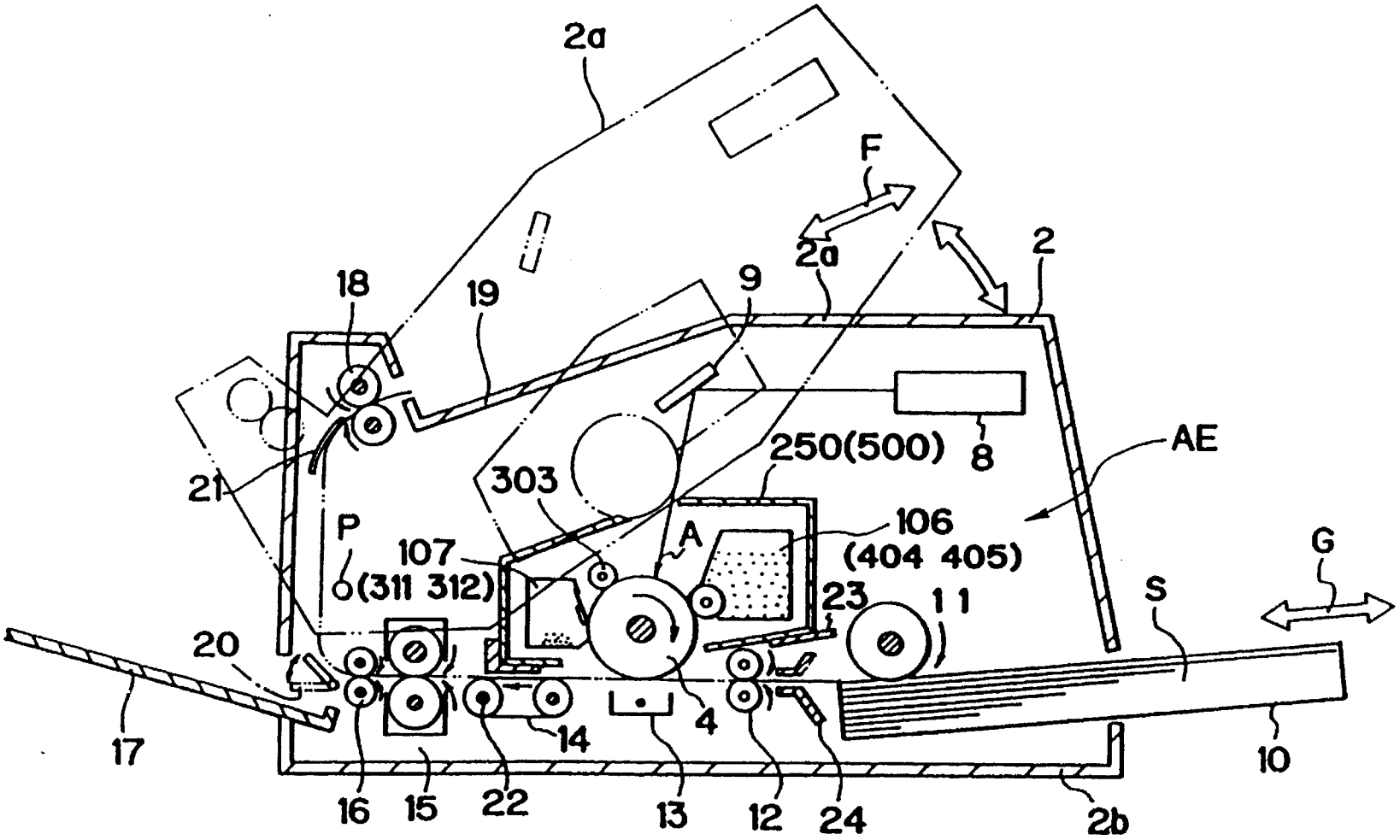
FIG. 8 is a lateral cross-sectional view of a laser beam printer in which the present invention is applicable.

Now reference is made to FIG. 8, for explaining a laser beam printer, in which the afore-mentioned process cartridge 250, 500 is detachably mounted. It is to be noted that, in FIG. 8, said process cartridge 250, 500 is only schematically illustrated.

As shown in FIG. 8, a laser beam printer 1 includes a process cartridge 250 (500) detachably mounted in a main body 2, and said process cartridge 250 (500) includes a photosensitive drum 104 (320) serving as the image bearing member, and process means such as a charger 303, a developing device 106 (404, 405 etc.), a cleaner 107 (311, 132) etc. positioned around said drum. In the upper part of the main body 2 there are provided a scanner unit 8 and a mirror 9 for emitting and guiding a laser beam.

The photosensitive drum 104 (302) uniformly charged by the charger 303 is irradiated by the laser beam, corresponding to the image information, from the unit 8 (indicated by arrow A), whereby a latent image corresponding to the image information is formed on the photosensitive drum 104 (302). Said latent image is developed into a toner image by the developing device 106 (404, 405 etc.). In the lower part of the main body 2, there is provided a sheet cassette 10 containing a plurality of sheets S serving as the recording medium (for example recording paper or overhead projector sheet). Next to the sheet cassette 10, there is provided a feed roller 11, which feeds the sheets S, one by one, from the cassette 10 to registration rollers 12. With a timing adjusted by the registration rollers 12, the sheet S is advanced to an image transfer position between the photosensitive drum 104 (302) and a transfer charger 13, and the toner image on said photosensitive drum 104 (302) is transferred, in said transfer position, onto the sheet S. After the toner image transfer, the sheet S is transported by a conveyor belt unit 14 to a fixing unit 15 for fixation of said toner image, and is discharged from the main body 2.

The laser beam printer of the present embodiment can select two methods in the discharge of the sheet S.

In the first face-up discharge method in which the sheets S are discharged with the image bearing faces thereof upwards, the sheet is discharged from face-up discharge rollers 16 onto a face-up discharge tray 17. In the second face-down discharge method in which the sheets S are discharged with the image bearing faces thereof downwards and in the order of pages, the sheet S is guided from said face-up discharge rollers 16 upwards through a transport direction switching mechanism such as a flapper 20 and a sheet guide member 21, thereby being inverted, and is discharged from face-down discharge rollers 18 onto a face-down discharge tray 19.

The maintenance works of the laser beam printer 1, such as the disposal of jammed sheet or replacement of the process cartridge 250 (500), are conducted by exposing the interior of the apparatus by rotating the upper part 2*a* of the main body 2 upwards about a shaft P, as indicated by chain lines, relative to the lower part 2*b*, and inserting a hand in a direction E.

Also, the attaching and detaching of the process cartridge 250 (500) are conducted in a direction F. More specifically, the cartridge 250 (500) is introduced into the main body 1 along the direction F, then is guided toward the mounting position, with the guides 301*a*1 of the cartridge guided by guide members (not shown) of the main body, and is supported in the mounting position by mounting means 22, 23. Subsequently the upper part 2*a* is rotated clockwise about the shaft P, whereby the apparatus becomes capable of image formation. With said clockwise rotation of the upper part 2*a*, an engaging part 301*d*3 of the protective cover 301*d* engages with an engaging part (not shown) of the main body, whereby the arms 301*d*2 are rotated anticlockwise to move the protective cover 301*d* to the retracted position D. On the other hand, when the upper part 2*a* is opened by anticlockwise rotation, said engaging parts are disengaged whereby the protective cover 301*d* moves to the protecting position C by the elastic force of the springs 301*d*4.

24 indicates guide numbers. The sheet cassette 10 can be attached and detached in a direction G. The foregoing embodiments are not limitative, and the photosensitive drum unit needs only to contain at least the photosensitive drum, while the developing unit needs only to contain at least the developing device.

As explained in the foregoing, the present invention realizes to shorten the assembling process.

What is claimed:

1. A process cartridge detachably mountable to a main assembly of a recording apparatus, said process cartridge comprising:

a first frame supporting an electrophotographic photosensitive member, said first frame having an engagement portion;

a second frame supporting development means for developing a latent image formed on said electrophotographic photosensitive member, said second frame having a shaft;

a connection member having a prevention portion for preventing disengagement of said shaft from said engagement portion; and a compression spring for applying a resilient force to said first frame and said second frame, wherein said first frame and said second frame are configured such that both longitudinal ends of said first frame overlap a portion of said second frame, when said first frame and said second frame are coupled together, in such a manner that an exposure aperture for irradiating said electrophotographic photosensitive member with image information when said process cartridge is mounted in the main assembly of the recording apparatus is formed in an upward direction and along a longitudinal direction of said electrophotographic photosensitive member between said first frame and said second frame.

2. A process cartridge according to claim 1, further comprising coupling means including said prevention portion and said compression spring, said compression spring generating an elastic force between said electrophotographic photosensitive member and said development means.

3. A process cartridge according to claim 2, wherein said coupling means is fixed by a screw to said first frame, and said first and second frames are coupled in a mutually rotatable manner about said shaft.

4. A process cartridge according to claim 3, wherein said shaft comprises a cylindrical member fixed on said second frame.

5. A process cartridge according to claim 2, wherein said coupling means comprises a base member, a hole provided in said base member for fixing said coupling means to said first frame by a screw member, a perpendicular plate formed as said prevention portion on said base member, and said compression spring provided on said base member, said coupling means being removable from said first frame by unscrewing said screw member so that said first frame and said second frame are separable from each other.

6. A process cartridge according to claim 2, wherein said development means comprises a developing sleeve with spacer rollers provided at both longitudinal ends thereof and said electrophotographic photosensitive member has a drum-like configuration, said developing sleeve being pressed toward said electrophotographic photosensitive drum by the elastic force of said compression spring such that said spacer rollers are abutted against a peripheral surface of said electrophotographic photosensitive drum.

7. A process cartridge according to claim 2, wherein said development means comprises a developing sleeve having spacer rollers provided at both longitudinal ends thereof and said electrophotographic photosensitive member has a drum-like configuration, and said developing sleeve and said electrophotographic photosensitive drum are mutually pressed by the elastic force of said compression spring such that said spacer rollers are abutted against a peripheral surface of said photosensitive drum.

8. A process cartridge according to claim 2, wherein said development means comprises a developing sleeve with spacer rollers provided at both longitudinal ends thereof and said electrophotographic photosensitive member has a drum-like configuration, said developing sleeve and said electrophotographic photosensitive drum being arranged with a gap therebetween due to the elastic force of said compression spring by urging said spacer rollers against a peripheral surface of said electrophotographic photosensitive drum.

9. A process cartridge according to claim 2, wherein said first frame has an extended portion extending in a direction crossing with the longitudinal direction of said electrophotographic photosensitive member above said electrophotographic photosensitive member at both longitudinal ends thereof, said extended portion overlapping a second frame portion disposed above said development means at both longitudinal ends thereof so that said exposure aperture is formed between said first frame and said second frame.

10. A process cartridge according to claim 1, wherein said electrophotographic photosensitive member comprises a drum shape, said development means comprises a developing sleeve, and relative positions of a periphery of said photosensitive drum and of a periphery of said developing sleeve are mutually defined in a state in which said first and second frames are coupled by abutment of spacer rollers provided at both longitudinal ends of said developing sleeve against said peripheral surface of said photosensitive drum.

11. A process cartridge according to claim 1, wherein said first frame is provided with charging means for charging said electrophotographic photosensitive member.

12. A process cartridge according to claim 11, wherein said first frame is provided with a cleaning member for cleaning said electrophotographic photosensitive member.

13. A process cartridge according to claim 1, wherein said first frame is provided with a cleaning member for cleaning said electrophotographic photosensitive member.

14. A process cartridge according to claim 1, wherein said first frame is provided with a protective cover, which can be opened and closed, for protecting said electrophotographic photosensitive member.

15. A process cartridge according to claim 14, wherein said protective cover is adapted to protect an image transfer area of said electrophotographic photosensitive member.

16. A process cartridge according to claim 1, wherein said electrophotographic photosensitive member has a drum-like configuration and has a helical drum gear at a lateral end thereof, said helical drum gear receiving a drive force from said main body when said process cartridge is mounted to the main assembly.

17. A process cartridge according to claim 16, wherein said development means comprises a developing sleeve having a developing sleeve helical gear provided at a lateral end of said developing sleeve, and said helical rum gear meshes with said developing sleeve helical gear, thereby transmitting a rotary driving force to said developing sleeve.

18. A process cartridge according to claim 16, wherein said first frame has an extended portion extending in a direction crossing with the longitudinal direction of said electrophotographic photosensitive drum above said electrophotographic photosensitive drum at both longitudinal ends thereof, said extended portion overlapping a second frame portion disposed above said development means at both longitudinal ends thereof so that said exposure aperture is formed between said first frame and said second frame.

19. A process cartridge according to claim 1, wherein said first frame has an extended portion extending in a direction crossing with the longitudinal direction of said electrophotographic photosensitive member above said electrophotographic photosensitive member at both longitudinal ends thereof, said extended portion overlapping a second frame portion disposed above said development means at both longitudinal ends thereof so that said exposure aperture is formed between said first frame and said second frame.

20. A recording apparatus onto which a process cartridge is removably mountable for recording on a recording medium, said recording apparatus comprising:

mounting means for removably mounting a process cartridge including a first frame supporting an electrophotographic photosensitive member and a second frame supporting development means for developing a latent image on said electrophotographic photosensitive member, wherein said first frame and said second frame are configured such that both longitudinal ends of said first frame overlap a portion of said second frame when said first frame and said second frame are coupled together and in such a manner that an exposure aperture is formed in an upward direction and along a longitudinal direction of said electrophotographic photosensitive member between said first frame and said second frame for irradiating said electrophotographic photosensitive member with image information when said process cartridge is mounted in said mounting means; and transport means for transporting the recording medium.

21. A recording apparatus according to claim 20, wherein said recording apparatus is a laser beam printer.

22. A recording apparatus according to claim 20, wherein said recording apparatus is an electrophotographic copying apparatus.

23. A process cartridge removably mountable onto a main body of an electrophotographic recording apparatus provided with a laser beam irradiation system for irradiating a laser beam, said process cartridge comprising:

an electrophotographic photosensitive drum;

a charging roller abutted against said electrophotographic photosensitive drum for charging said electrophotographic photosensitive drum;

a rotatable development sleeve for supplying toner to said electrophotographic photosensitive drum and for developing a latent image formed on said electrophotographic photosensitive drum;

a cleaning blade abutted against said electrophotographic photosensitive drum for removing residual toner therefrom;

a cleaning frame provided with said electrophotographic photosensitive drum, said charging roller, and said cleaning blade, said cleaning frame having an engagement portion;

a development unit, connectable with said cleaning frame, provided with said development sleeve and a toner containing portion for containing toner to be used by said development sleeve for development of a latent image, said development unit having a shaft engageable with said engagement portion of said cleaning frame when said cleaning frame and said development unit are connected, said development unit being rockably connected to said cleaning frame about said shaft, and said toner containing portion being provided with a grip portion for gripping said process cartridge; and prevention means for preventing disengagement of said shaft of said development unit from said engagement portion of said cleaning frame; and a compression spring for applying a resilient force to said cleaning frame and said development unit, wherein both longitudinal ends of said cleaning frame in a longitudinal direction of said electrophotographic photosensitive drum extend above said development unit so as to overlap a part of said development unit to thereby form an exposure aperture between said cleaning frame and said development unit, said exposure aperture extending in the longitudinal direction of said electrophotographic photosensitive drum and creating an opening in an upward direction for enabling a laser beam from the laser beam irradiation system to irradiate said electrophotographic photosensitive drum, said process cartridge being mounted onto the main body by gripping said grip portion while orienting said cleaning frame in a forward direction and said toner containing portion in a rearward direction.

24. A process cartridge according to claim 23, wherein said compression spring is provided on said prevention means.

25. A process cartridge according to claim 23, wherein said prevention means is fixed to said cleaning frame by a screw member, and is removed from said cleaning frame by unscrewing said screw member.

26. A recording apparatus, on which a process cartridge is removably mountable, for recording on a recording medium, said recording apparatus comprising:

mounting means for removably mounting a process cartridge including an electrophotographic photosensitive drum; a charging roller abutted against the electrophotographic photosensitive drum for charging the electrophotographic photosensitive drum; a rotatable development sleeve for supplying toner to the electrophotographic photosensitive drum and for developing a latent image formed on the electrophotographic photosensitive drum; a cleaning blade abutted against the electrophotographic photosensitive drum and for removing residual toner therefrom; a cleaning frame provided with the electrophotographic photosensitive drum, the charging roller, and the cleaning blade, the cleaning frame having an engagement portion; a development unit, connectable with the cleaning frame, provided with the development sleeve and a toner containing portion for containing toner to be used by the development sleeve for development of a latent image, the development unit having a shaft engageable with the engagement portion of the cleaning frame when the cleaning frame and the development unit are connected, the development unit being rockably connected to said cleaning frame about the shaft, and the toner containing portion being provided with a grip portion for gripping the process cartridge; prevention means for preventing disengagement of the shaft of the development unit from the engagement portion of said cleaning frame; and a compression spring for applying a resilient force to the cleaning frame and the development unit, wherein both longitudinal ends of the cleaning frame in a longitudinal direction of the electrophotographic photosensitive drum extend above the development unit so as to overlap a part of the development unit to thereby form an exposure aperture between said cleaning frame and said development unit, said exposure aperture extended in the longitudinal direction of the electrophotographic photosensitive drum and creating an opening in an upward direction enabling a laser beam from a laser beam irradiation system to irradiate the electrophotographic photosensitive drum, the process cartridge being mounted onto said main body by gripping the grip portion while orienting the cleaning frame in a forward direction and the toner containing portion in a rearward direction; and transport means for transporting the recording medium.

27. A recording apparatus according to claim 26, wherein said prevention means is fixed to the cleaning frame by a screw member, and is removed from the cleaning frame by unscrewing the screw member.

* * * * *

UNITED STATES PATENT AND TRADEMARK OFFICE

CERTIFICATE OF CORRECTION

PATENT NO. : 5,581,328

DATED : December 3, 1996

INVENTOR(S) : MASAHIKO YASHIRO

It is certified that error appears in the above-indentified patent and that said Letters Patent is hereby corrected as shown below:

On the title page, Item

[30] Foreign Application Priority Data:

Insert --April 10, 1992 PCT JP92/00450--.

Item

[56] References Cited:

Under "U.S. PATENT DOCUMENTS", "Ohmori" should read --Ohmori et al.--; and

Under "FOREIGN PATENT DOCUMENTS", "1244472" should read --1-244472--.

Item

[57] ABSTRACT:

Line 1, "to shorten" should read --a shortening of--; and
Line 5, "develope" should read --develop--.

COLUMN 6:

Line 37, "which formed is" should read --which is formed--; and
Line 62, delete "406b".

COLUMN 7:

Line 6, "Screw 406b" should read --Screws 406b and 406d--; and
Line 31, "recess" should read --recesses--.

UNITED STATES PATENT AND TRADEMARK OFFICE

CERTIFICATE OF CORRECTION

PATENT NO. : 5,581,328

DATED : December 3, 1996

INVENTOR(S) : MASAHIKO YASHIRO

It is certified that error appears in the above-indentified patent and that said Letters Patent is hereby corrected as shown below:

COLUMN 8:

Line 3, "cooperate" should read --cooperate with--;
Line 26, "the" should be deleted;
Line 32, "250,500" should read --250 (500)--;
Line 33, "250,500" should read --250 (500)--; and
Line 41, "132)" should read --312)--.

COLUMN 9:

Line 44, "to shorten" should read --a shortening of--.

COLUMN 11:

Line 33, "rum" should read --drum--.

Signed and Sealed this

Twentieth Day of May, 1997

*Attest:*

Bruce Lehman

BRUCE LEHMAN

*Attesting Officer*

*Commissioner of Patents and Trademarks*